United States Patent [19]

Rogers, Jr.

[11] Patent Number: 4,669,778

[45] **Date of Patent: * Jun. 2, 1987**

[54] FOOTREST ASSEMBLY FOR RECLINER CHAIRS

[75] Inventor: Walter C. Rogers, Jr., Denton, N.C.

[73] Assignee: Parma Corporation, Denton, N.C.

[ * ] Notice: The portion of the term of this patent subsequent to Feb. 18, 2003 has been disclaimed.

[21] Appl. No.: 517,750

[22] Filed: Jul. 27, 1983

Related U.S. Application Data

[63] Continuation-in-part of Ser. No. 478,228, Mar. 24, 1983, Pat. No. 4,570,996.

[51] Int. Cl.[4] ..... A47C 1/035

[52] U.S. Cl. ..... 297/85; 297/68

[58] Field of Search ..... 297/85, 68, 84, 83, 297/89, 91, 217, 219, 429; 5/13

[56] References Cited

U.S. PATENT DOCUMENTS

| | | | |
|---|---|---|---|
| 283,111 | 8/1883 | Isberg | 297/429 |
| 2,869,616 | 1/1959 | Belisle . | |
| 2,922,464 | 1/1960 | Belisle | 297/84 |
| 2,929,440 | 3/1960 | Schliephacke | 297/84 |
| 2,948,331 | 8/1960 | Schliephacke | 297/84 |
| 3,010,761 | 11/1961 | Teague, Jr. | 297/84 |
| 3,047,336 | 7/1962 | Schliephacke | 297/85 |
| 3,128,122 | 4/1964 | Mizelle | 297/85 |
| 3,206,775 | 9/1965 | Filson | 5/118 |
| 3,330,243 | 1/1967 | Mizelle | 297/85 |
| 3,429,612 | 2/1969 | Cobb | 297/429 |
| 3,494,660 | 2/1970 | Caldemeyer et al. | 297/68 |
| 3,572,820 | 3/1971 | Ferguson | 297/84 |
| 3,781,060 | 12/1973 | Pentzien | 297/68 |
| 3,880,426 | 4/1975 | Mednick | 297/84 |
| 4,113,305 | 9/1978 | Hampton | 297/85 |
| 4,190,282 | 2/1980 | Crawford | 297/68 |
| 4,236,754 | 12/1980 | Ehlers | 297/423 |

FOREIGN PATENT DOCUMENTS

| | | | |
|---|---|---|---|
| 1529513 | 3/1966 | Fed. Rep. of Germany . | |
| 1208630 | 2/1960 | France | 297/84 |
| 843639 | 8/1960 | United Kingdom . | |
| 888706 | 1/1962 | United Kingdom . | |

*Primary Examiner*—Kenneth J. Dorner
*Assistant Examiner*—Mark W. Binder
*Attorney, Agent, or Firm*—William E. Mouzavires

[57] ABSTRACT

A footrest assembly for a reclining chair wherein the support members of the footrest are substantially concealed from view even when in the extended position projected forwardly from the front of the chair. In the preferred embodiments, the assembly includes a flexible cover of sheet-like material attached between the footrest and the seat frame. In one preferred embodiment, the cover is also attached to the footrest support members. The footrest support members are preferably formed by an extendable and retractable linkage system whose links are arranged in a novel manner to allow the cover to substantially conceal the same.

30 Claims, 9 Drawing Figures

FOOTREST ASSEMBLY FOR RECLINER CHAIRS

RELATED APPLICATION

The present application is a continuation-in-part of my copending U.S. application Ser. No. 06/478,228, filed Mar. 24, 1983, now U.S. Pat. No. 4,570,996, entitled "Footrest Assembly For Reclining Chairs". The disclosure of my aforementioned application Ser. 06/478,228 is hereby incorporated by reference into the present application and made part hereof.

BACKGROUND OF INVENTION

The great majority of recliner chairs manufactured today utilize a footrest or ottoman that is mounted on a linkage mechanism which moves between a retracted, folded position below the front portion of the chair and an extended position projected forwardly from the front of the chair. The extended position of the linkage is, of course, used to place the footrest in position for receiving the feet and/or legs of the occupant of the chair as he sits in TV position or an advanced reclining position.

It is highly conventional in the recliner chair industry for footrest linkages to be made from a series of steel links pivoted together in an articulated fashion so as to be operable, for example, in the manner of a lazy-tong or pantograph linkage. Moreover, the footrest proper or ottoman is typically supported by two footrest linkage systems each connected to the footrest at one end and mounted to the chair frame at the other end. When the footrest is in the extended position, both footrest linkages are usually exposed along their intermediate portions. This exposure can present a potential hazard particularly to children or domestic pets should their extremities become caught between the links as the links fold towards closed or retracted position. Additionally, if the edges of the links are exposed, accidental striking against the exposed edges may cause injury to persons particularly in cases where, for example, the manufacturer has inadvertently failed to smooth or roll the edges of the metallic links during the manufacturing process.

Conventional footrest linkages have also suffered over the years from being unsightly. Thus, while considerable advancements have been made over the years in the overall styling of recliner chairs as well as in the arrangement and operation of the linkage systems thereof, virtually no improvement has been made to the footrest linkage from the standpoint of safety and appearance. While various flexible covers have been attached between the footrest and the chair frame to cover the space therebetween when the footrest is extended, these covers, by necessity, do not extend laterally sufficiently to conceal the footrest linkage for otherwise, they would interfere with the operation of the linkage system. The result is that today the footrest linkages of recliner chairs still stand as an eyesore in contrast to the advanced chair styling which surrounds the same.

OBJECTS OF THE PRESENT INVENTION

It is therefore an object of the present invention to provide, for recliner chairs, a new and improved footrest assembly which will enhance the appearance of the chair and yet will be safe and effective. Additionally, it is an object to provide a recliner chair incorporating the aforementioned footrest assembly.

A further object of the present invention is to provide such a footrest assembly whose supporting members may be substantially concealed from view when the footrest is in extended position projected forwardly from the associated chair. Included herein is such a footrest assembly whose supporting members may be covered by material to match the chair upholstery material or with any other suitable material of pleasing appearance.

Another important object of the present invention is to provide a footrest assembly including a linkage for mounting and supporting a footrest between extended and retracted positions in a reclining chair, which linkage is safe and effective while also capable of being provided in an attractive design that will not detract from the appearance of the chair. Included herein is such a footrest linkage which presents virtually no sharp edges or other parts when in the extended position so as to minimize the potential for injury to persons nearby or using the chair. Further included herein is such a footrest linkage whose internal linkage parts may be substantially concealed from view even when in the extended position.

A further object of the present invention is to provide such a footrest linkage as described above and which may be incorporated in virtually any type of new or existing recliner chair to be actuated by a handle or a "gravity" mechanism or by any other actuating method or system of the prior art.

Another object of the present invention is to provide a recliner chair incorporating the aforementioned footrest assembly including the linkage thereof.

A still further object of the present invention is to provide novel method and apparatus for covering parts of a footrest linkage to increase the safety and appearance thereof.

SUMMARY OF INVENTION

In summary, the footrest assembly of the present invention includes a footrest (also termed "ottoman"), and extendable and retractable support members for mounting the footrest to the frame of an associated chair, preferably a reclining chair. The support members are provided in identical or substantially identical pairs spaced laterally from each other to operate in unison in extending and retracting the footrest. In the preferred embodiments, a cover of flexible sheet-like material is attached to and between the footrest and the frame of the associated chair. In one preferred embodiment, the cover also spans the space between, and is attached to, opposite portions of the support members to conceal the same in the extended position of the footrest. In another preferred embodiment, the cover not only covers the space between the opposite portions of the support members but also extends beyond the support members to substantially conceal the same without being attached to the support members. In another embodiment, only the support members themselves are covered leaving the space therebetween open.

In the preferred embodiment, the footrest support members are formed by linkage systems whose links are arranged in novel manner to allow the cover to substantially conceal the links while also, at the same time, avoiding interference with the operation of the linkages during movement between extended and retracted positions of the footrest. Other features and advantages of the present invention are described below.

DRAWINGS

Other objects and advantages of the present invention will be apparent from the following more detailed description taken in conjunction with the attached drawings in which.

DETAILED DESCRIPTION

Figures 1, 2, 3:
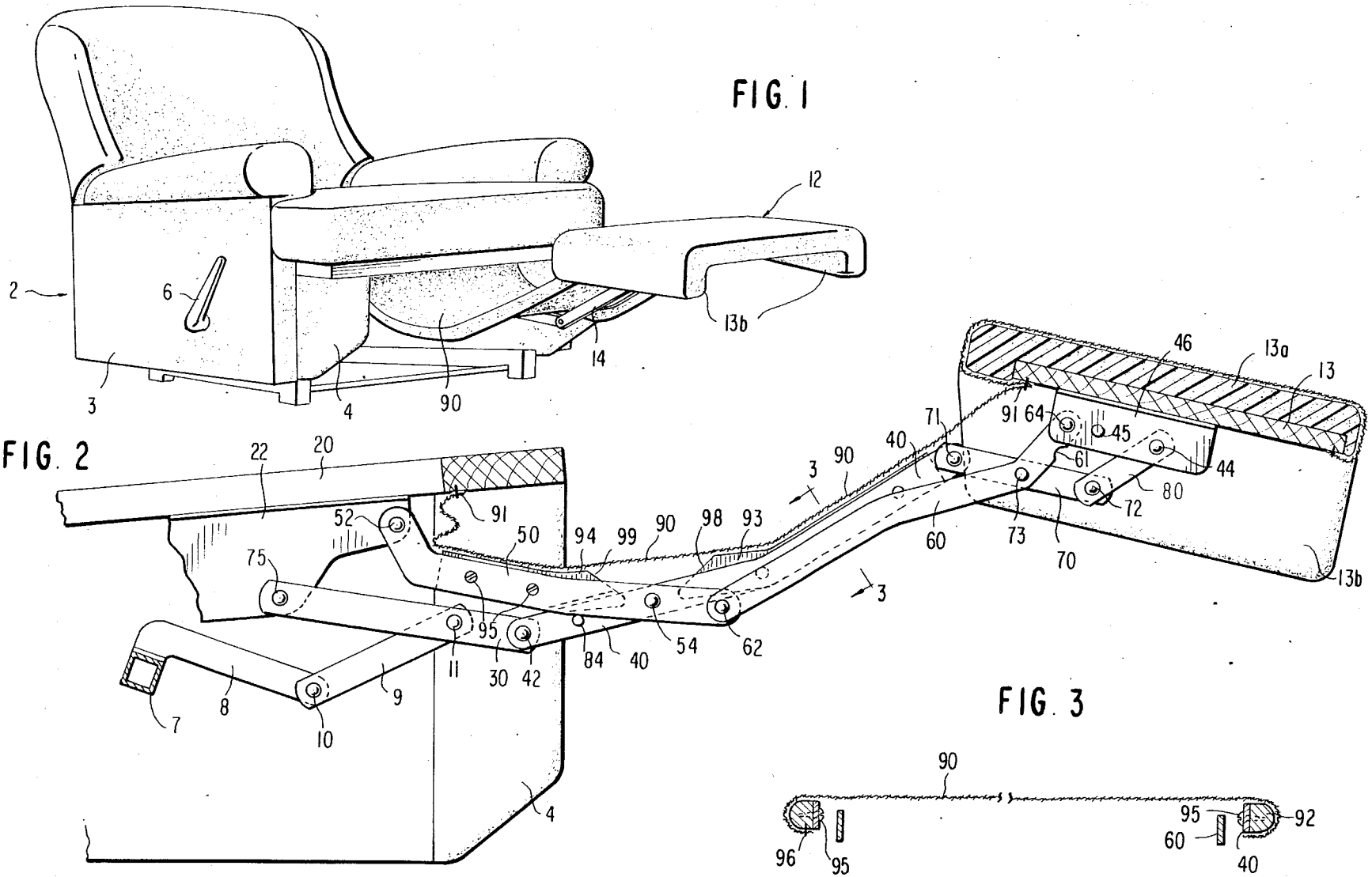
FIG. 1 is a perspective view of a recliner chair incorporating one preferred embodiment of the footrest assembly of the present invention, the latter being shown in the extended position thereof.
FIG. 2 is a cross-sectional view of the chair of FIG. 1 as seen from the inside looking out and with portions removed.
FIG. 3 is a cross-sectional view taken generally along lines 3—3 of FIG. 2.

Referring now to FIG. 1, there is shown for illustrative purposes only, a recliner chair generally designated 2 incorporating a preferred embodiment of the footrest assembly, generally designated 12, of the present invention; the footrest assembly being shown in the extended position where it is projected forwardly from the chair. Apart from the footrest assembly of the present invention, the recliner chair may be of any suitable type, such as a "one-way", "two-way" or a "three-way" reclining chair and even a rocking reclining chair or a rocking and/or swiveling recliner chair (both not shown). In the specific embodiment shown, the armrests 3 are stationary and the footrest 12 is actuated to the extended TV position by means of a handle 6 mounted on one of the armrests as is typical in the art. The seat and backrests generally designated 4 and 5 respectively may be fixed or moveable relative to each other while being moveable relative to the armrests 3 depending on the particular design desired. It should therefore be understood that the footrest assembly of the present invention may be incorporated into various designs and styles of recliners.

Figure 4:
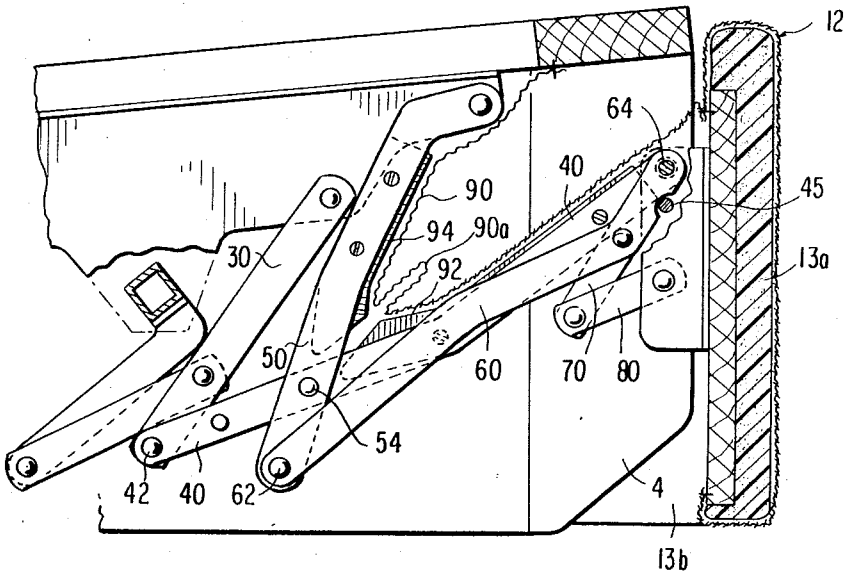
FIG. 4 is a view similar to FIG. 2 except that the footrest assembly is shown in the retracted or closed position.

FIG. 1 also illustrates a cover generally designated 90 in accordance with the invention, for support members generally designated 14 which mount and support the footrest 12 relative to the chair for movement between the extended position shown in FIG. 1 and a retracted position where the footrest 12 extends downwardly generally in a vertical plane below seat 4 as best shown in FIG. 4. In the preferred forms of the invention shown and to be described below, footrest mounting members 14 on opposite sides of the chair take the form of novel linkage systems which are identical and spaced laterally from each other with one of their ends mounted to the chair frame which, in the specific embodiment, are the armrests 3, and with the other of their ends mounted to the footrest 12 as will be described in greater detail. Inasmuch as the footrest linkage systems shown on opposite sides of the chair are identical, only one system will be described below.

Referring now to FIGS. 2 and 4, the footrest linkage system of the preferred embodiment includes six links, namely 30, 40, 50, 60, 70 and 80. Links 30 and 50 may be termed "mounting links" because they are mounted at pivots 75 and 52 respectively relative to the chair. In the specific embodiment shown, link 50 is mounted by pivot 52 relative to the seat frame 20 by means of a seat link 22 which is elongated and extends below the seat frame 20 and is fixed thereto by screws or rivets or any other suitable fasteners so as to act as a mounting bracket for various links as will be described. The other mounting link 30 is pivoted by pin 75 also to seat link 22.

Links 40 and 60 are pivotally connected to the footrest assembly; link 40 being connected by means of links 70 and 80 while link 60 being directly connected to the footrest 12 at pivot 44. Link 70 is pivotally connected to the forward end of link 40 by pivot 71 while the opposite end of link 70 is pivotally connected by pivot 72 to link 80. The latter is pivotally connected to the footrest by pivot 44. Additionally, link 70 is pivotally connected intermediate its ends by pivot 73 to link 60. In the specific embodiment shown, the footrest 12 includes an internal frame 13 made of any suitable material such as wood covered by suitable upholstery 13*a*. The opposite sides of the armrest frames at their lower front portions are provided with panels 4 which project forwardly in parallel planes recessed inwardly from the outer surfaces of the frames where they serve to conceal portions of the footrest linkage when in extended position. The opposite sides of the footrest are provided with flanges 13*b* normal to the plane of the footrest body. The footrest flanges 13*b* straddle the panels 4 when the footrest is in closed position as shown in FIG. 4. The panels 4 are preferably upholstered in any suitable manner. It will also be noted that the footrest flanges 13*b* serve to further conceal links 70, 80, 46 and portions of link 60.

A bracket link 46 is fixed to the backside of footrest frame 13 to act as a mounting bracket receiving the pivots 44 and 64 which serve to pivotally mount the links 60 and 80 to the footrest 12. As clearly shown in the drawings, pivots 44 and 64 are spaced from each other along a line which extends generally parallel to footrest frame 13. Moreover, links 46, 80, 70 and 60 form a four-bar linkage between pivots 44, 64, 72 and 73. It should also be noted that pivots 64 and 71 are aligned one behind the other when the footrest is in closed position shown in FIG. 4. Additionally, a stop 45 is fixed to bracket link 46 to engage the recessed edge 61 of link 60 to define the fully closed position of footrest 12 relative to links 40 and 60. The extended position of the footrest linkage is determined by stop 84 which engages the lower edge of link 50 as shown in FIG. 2.

As clearly seen in FIGS. 2 and 4, links 30 and 40 are pivotally interconnected at their end portions by pivot 42. Links 50 and 60 are also pivotally interconnected, by pivot 62. Additionally, link 50 at its one end, nearest pivot 62, is pivotally connected by pivot 54 to an intermediate portion of link 40. Link 50 may, of course, be laterally offset along its body to facilitate the latter as is well-known in the recliner-linkage art. Referring to FIG. 2, it will thus be seen that two four-bar linkages are formed, one being defined between pivots 52, 75, 42 and 54 and the other being pivots 54, 62, 73 and 71.

In the TV position of the chair wherein the footrest 12 is extended as shown in FIG. 2, links 50 and 60 form an extension of one another as do links 30 and 40. Additionally, link 40 is positioned substantially behind link 60 to be substantially concealed thereby, while link 50 is positioned above link 30. Furthermore, links 30, 40, 50 and 60 extend in adjacent parallel planes. As the shapes of the links 30, 40, 50 and 60 are clearly disclosed in the drawings, they need not be described here.

Actuation of the footrest linkage to place the footrest 12 into the extended position is achieved by manual rotation of handle 6 which is fixed to a shaft 7. A drive linkage including links 8 and 9 interconnects shaft 7 and link 30. Link 8 is fixed at one end to shaft 7 while its other end is pivotally connected by pivot 10 to one end of link 9. The opposite end of link 9 is pivotally connected to link 30 by pivot 11. It will therefore be seen that rotation of handle 6 will cause linkage 8, 9 to swing link 30 from its folded or closed position shown in FIG. 4 to the extended position shown in FIG. 2. This, of course, will have the effect of actuating all of the four bar linkages of the footrest linkage to position them and the footrest 12 in the position shown in FIG. 2. Of course, any other suitable actuation mechanism may be employed to actuate the footrest assembly. Moreover, as noted above, any suitable recliner mechanisms may be employed with the footrest assembly of the present invention to actuate the seat and backrest relative to the base into TV or advanced reclining position (not shown). As the present invention is directed to the footrest assembly, the foregoing mechanisms need not be described.

The unique footrest linkage shown and described allows the cover 90 to be applied thereto in accordance with the present invention so as to substantially conceal the footrest linkage. The opposite ends of the cover 90 are attached such as by tacking 91 to the footrest frame 13 and the seat frame 20. Additionally, and in accordance with the present invention, the cover 90 is attached along its opposite side margins to footrest links 40 and 50 so as to cover the same as shown in FIG. 3.

Figure 7:
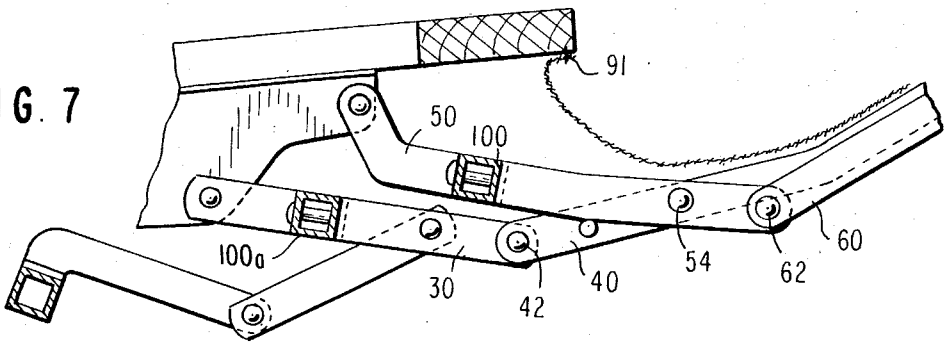
FIG. 7 is a fragmental view generally similar to FIG. 3 except showing another preferred embodiment of the footrest assembly of the present invention.

In the preferred embodiment, means are fixed to the outer sides of links 40 and 50 to receive and fix the margins of cover 90 thereto. In the specific embodiment shown, elongated blocks or molding strips of wood 92, 94 are fixed to the outer sides of links 40 and 50 by means of fasteners 95 inserted through apertures in the links 40 and 50 and into the strips 92, 94. As is also shown in FIG. 7, the cross section of strips 92, 94 in the specific embodiment is generally cylindrical, however, other shapes may, of course, be utilized if desired. Additionally, other materials such as foam or plastic may be utilized in making the strips 92, 94. As shown in FIG. 3, the marginal sides of cover 90 are placed on and about the surface of strips 92, 94 and secured to their underside in any suitable manner such as by tacks 96 (one shown in FIG. 3). In the specific embodiment shown, the strips 92, 94 are mitered on opposite sides of pivot 54 such as shown at 98 and 99 in FIG. 4 to allow the links 50, 60 to fold into their fully closed position as shown in FIG. 4 without interference from the strips 92, 94.

The configuration and geometry of the footrest linkage is also such as to provide a cavity between links 40 and 50 when the footrest linkage is in the closed or folded position of FIG. 4. This cavity accommodates cover 90 and particularly the intermediate or transitional section **90*a* which is not attached to the strips 92, 94 but rather is free to fold into the cavity as shown in FIG. 4. Cover 90 may be formed from any suitable sheet-like, flexible material which may correspond or be identified to the upholstery material of the footrest 12, and the remainder of the chair parts 3 and 4. Cover 90 may also be made from a structural material such as woven polypropylene or a combination of conventional upholstery material and structural material. This would, of course, increase the strength of the cover 90 which would aid the capability of the cover 90 to minimize side sway of the footrest linkages, which capability is another advantage made possible by attaching the cover 90 to the footrest linkages. To increase the strength of the cover material in cases where it is a woven material, the material could be bias cut so that the warp and fill strands or threads would extend at an angle to the transverse or longitudinal direction of the cover 90. Use of the aforementioned structural material could also be made at the intermediate or transitional section 90*a* (see FIG. 4) of the cover in order to control the folding at the section so that it would fold as desired into the cavity between links 40 and 50 as shown in FIG. 2**.

Figure 5:
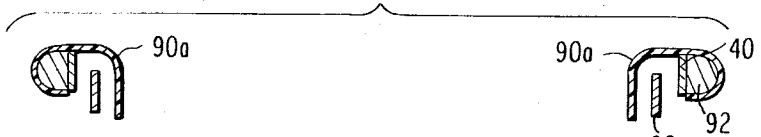
FIGS. 5 and 6 are views similar to FIG. 3 but illustrating two different modifications of the footrest cover respectively.
Figure 6:
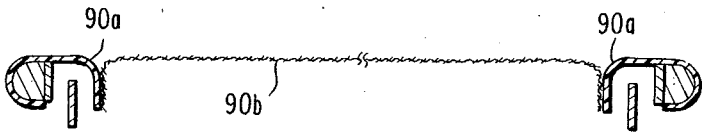

Although the preferred embodiment utilizes a cover 90 which not only covers the footrest linkage mechanism, but also the space between the opposite footrest linkages in other embodiments it may be desirable to cover only the footrest linkages themselves while leaving the space open between the footrest linkages on opposite sides of the chair. This is illustrated in FIG. 5 which shows a modification of the cover arrangement which leaves the space between the opposite linkage mechanisms open. In this modification, the cover **90*a*, which may be termed a "shroud", is secured to strips 92 fixed to links 40 and 50 (only 40 shown in FIG. 5) and extends inwardly over links 60 and 30 and then downwardly adjacent to and covering the inside surface of the aforementioned links. Shrouds 90*a* may be molded or otherwise made from self-supporting wood, rubber, plastic or fabric material or combinations thereof preferably with a self-supporting or semirigid body so as to facilitate proper positioning of the shrouds 90*a* in spaced relation to links 60 and 30 as best illustrated in FIG. 5. If desired, a flexible cover 90*b* of any suitable material may be attached to and between shrouds 90*a* to cover the space between the opposite footrest linkages on opposite sides of the chair similar to the cover described above in FIGS. 1 to 4. This is illustrated by the modification shown in FIG. 6**.

Figure 8:
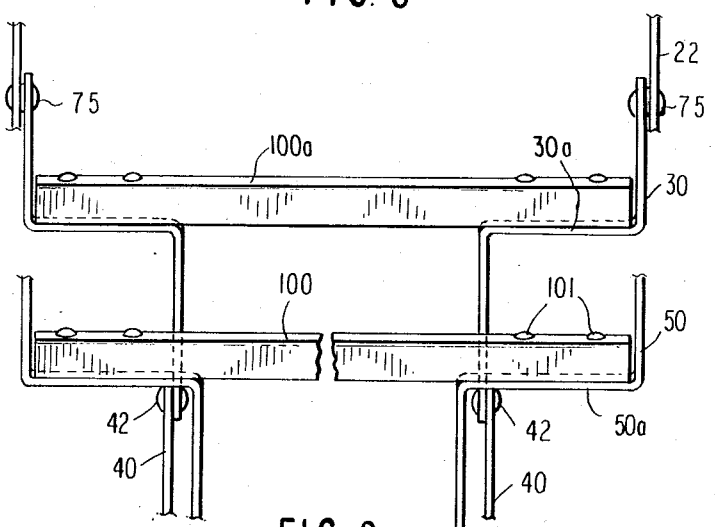
FIG. 8 is a fragmental plan view of FIG. 7.
Figure 9:
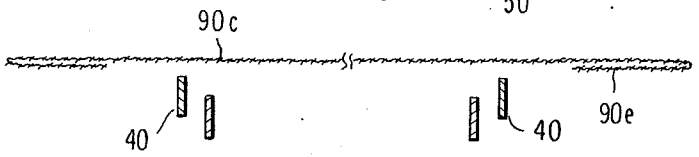
FIG. 9 is a cross-sectional view across the footrest cover of the embodiment of FIGS. 7 and 8.

Another method of covering and concealing the footrest linkage is illustrated in FIGS. 7, 8 and 9 which utilizes the same footrest linkage as shown in FIGS. 1 to 4 except that the mounting links 30 and 50 are provided with laterally offset portions **30*a* and 50*a* in order to offset links 40 and 60 inwardly of the chair to conceal them from view when covered by a cover 90*c* shown in FIG. 9. In addition, a cross brace 100 is fixed by fasteners 101 to and between the offset portions 50*a* of links 50 on opposite sides of the system to strengthen the same as best shown in FIG. 8. Similarly, a cross-brace 100*a* is fixed between offset portions 30*a* of links 30. Inasmuch as links 40 and 60 are recessed substantially inwardly as shown and described, they may be easily concealed by a flexible cover 90*c* which need merely be extended laterally beyond the links 40 and 60 without being attached thereto as best shown in FIG. 9. Cover 90*c* need only be attached to the seat frame (at 91 see FIG. 7) and the footrest frame (see FIG. 2). Cover 90*c* may be made from any suitable material such as cover 90 described above and it may also be provided with a hem 90*e* on its opposite side margins as shown in FIG. 9**.

In one preferred embodiment, links 30 and 50 may be recessed inwardly approximately one-third the distance to the longitudinal center line between the linkages on opposite sides of the chair. For example, and with reference to FIG. 8, in one embodiment where the distance between the links 30 between pivots 75 is about twenty inches (20"), the distance of offset portions 30*a* may be as much as about three inches (3") thereby allowing the distance between links 40 at pivots 42 to be about fourteen inches (14").

It will thus be seen that the unique footrest linkage of the present invention allows several different methods of uniquely covering the linkage parts to enhance appearance and safety. As will be apparent from FIG. 1, the footrest assembly of the present invention in the extended position possesses a highly attractive profile with minimum linkage exposure in contrast to that of conventional footrest assemblies which utilize exposed pantograph or lazy-tong linkage systems. Additionally, the footrest linkage of the present invention eliminates or minimizes exposed spaces between links as well as link edges that would otherwise present a hazardous condition. In covering the entire area between the footrest linkages on opposite sides of the chair, the cover 90 of the present invention provides an extremely attractive as well as safe surface while also serving to minimize side sway between said linkages.

It should be understood that various types of "one-way", "two-way" or "three-way" recliner chairs and seat linkage systems (not shown) may be employed in conjunction with the footrest linkage of the present invention. In such other chairs, the footrest linkage may be actuated through a handle typically mounted to one side of the chair such as disclosed in my U.S. Pat. Nos. 4,226,469 or 4,108,491 or it may be actuated by a gravity mechanism such as shown in my U.S. Pat. No. 4,350,387. Additionally, the footrest linkage may be actuated through the armrests such as shown in my U.S. Pat. Nos. 4,185,869 and 4,249,772 or by other suitable means including that disclosed in the parent application Ser. No. 06/478,228 identified above. It therefore should be apparent that the footrest assembly of the present invention should not be limited to the specific chair and actuating system shown, described or identified herein. Additionally, while several different methods of covering the footrest linkage have been shown and described herein, the unique footrest linkage of the present invention will allow other methods of covering or concealing the linkage parts. Moreover, other modifications and variations of the present invention will no doubt become readily apparent to those skilled in the art but without departure from the scope of the present invention which is indicated in the appended claims.

What is claimed is:

1. A footrest assembly for a recliner chair comprising in combination, a footrest, a pair of support and mounting members laterally spaced from each other and having first ends attached to the footrest and second opposite ends adapted to be mounted to an associated chair to support the footrest for extendable and retractable movement relative to the chair, and each member having a cover directly attached thereto and extending alongside inner and outer side portions and about a top portion thereof, said cover having a foldable portion movable into a folded position behind the footrest when the footrest is retracted.

2. The footrest assembly defined in claim 1 wherein each of said members comprises a linkage system.

3. The footrest assembly defined in claim 2 wherein each of said linkage systems includes a first pair of links pivotally connected to the footrest, a second pair of links pivotally connected to the first pair respectively and being adapted to be mounted to an associated chair, said cover being attached to links in each of said first and second pairs of links.

4. The footrest assembly defined in claim 3 wherein said links in each of said first and second pairs of links include cover-receiving members fixed on outer sides thereof, said cover being attached to said cover-receiving members.

5. The footrest assembly defined in claim 3 wherein one of said links of said second pair of links is pivotally connected to both of said links of said first pair.

6. The footrest assembly defined in claim 2 wherein said cover is made from self-supporting material.

7. The footrest assembly defined in claim 6 wherein said cover extends about upper edges of links in said linkage system while overlying and spaced from inner side portions thereof.

8. The footrest assembly defined in claim 1 wherein said members have mounting means receiving marginal side portions of said cover, and said cover is attached to said means.

9. The footrest assembly defined in claim 1 further including a flexible cover extending between and attached to said first-defined covers.

10. The footrest assembly defined in claim 6 further including a flexible cover extending between and attached to said first-defined covers.

11. The footrest assembly defined in claim 2 wherein each linkage system defines a cavity when the footrest is retracted, said cover being receivable in the cavities defined by the linkage systems when the footrest is retracted.

12. A footrest assembly for a recliner chair comprising in combination, a footrest, a pair of support and mounting members laterally spaced from each other and having first ends attached to the footrest and second opposite ends adapted to be mounted to an associated chair to support the footrest for movement relative to the chair between extended and retracted positions, each of said members including a linkage system including a pair of links pivotally interconnected for movement between extended and retracted positions, one of said pair of links being connected to the footrest and the other of said pair of links being adapted to be connected to a recliner chair, each pair of links having along a length thereof means defining a cavity therebetween when in the retracted position, and a foldable cover extending over said links and having portions on opposite sides thereof respectively received in the cavities when the footrest is in said retracted position, and wherein each pair of links and said means are arranged such that when in the retracted position said cavity extends along said pair of links a distance sufficient to receive a substantial portion of the cover including a foldable portion of the cover.

13. The footrest assembly defined in claim 12 wherein said cover extends substantially laterally beyond the members to conceal the members when the footrest is in the extended position.

14. The footrest assembly defined in claim 13 wherein said cover is not attached to said members while having one end attached to the footrest.

15. The footrest assembly defined in claim 12 wherein said cover is attached to said members.

16. A reclining chair comprising in combination a seat, a support means, a footrest assembly including a footrest and a pair of laterally spaced linkage systems interconnected between said support means and said footrest for supporting said footrest between a retracted position below the seat and an extended position projected forwardly from the seat, and means covering said linkage systems including a foldable cover extending laterally over and beyond said linkage system substantially throughout the distance between said footrest and said seat when the footrest is in said extended position thereof, and wherein said linkage systems include portions offset substantially inwardly of the chair and wherein said cover extends laterally outwardly substantially beyond said offset portions and has a folded position when the footrest is in the retracted position, and wherein each of said linkage systems include a first link connected to said footrest, a second link connected to the chair and connected to said first link, said first and second links having along a length thereof means defining a cavity in the retracted position of the footrest and wherein said cavity extends a sufficient distance along said first and second links to receive a substantial part of the cover at one side portion of the cover, and with said cavity also receiving a foldable portion of the cover.

17. The chair defined in claim 16 further including recessed side panels projecting forwardly from opposite sides of the chair to cover portions of said linkage systems when in the extended position.

18. The chair defined in claim 17 wherein said footrest includes opposite flange portions received over said panels when the footrest is in said retracted position.

19. The chair defined in claim 16 wherein said cover is attached at opposite ends to the seat and footrest respectively.

20. The chair defined in claim 19 wherein said cover is not attached to the offset portions of the linkage systems.

21. For use in a reclining chair, a footrest linkage including a bracket link adapted to be fixed to a footrest, a first pair of links extending in generally side-by-side interrelationship with one link located generally behind the other link, linkage means pivotally interconnecting the first pair of links and being pivotally connected to the bracket link, a second pair of links having portions extending in spaced vertical planes generally parallel to those of said first pair of links and further having end portions adapted to be pivotally mouunted with respect to an associated chair for providing swinging movement of said second pair of links between retracted positions located under the chair and extended positions projected forwardly from the chair, said first and second pairs of links being respectively pivotally connected to each other such that said first pair of links will extend generally forwardly from the second pair of links when the second pair are in said extended positions thereof and wherein said linkage means includes a first link pivotally interconnecting said first pair of links, and a second link pivotally interconnecting said first link and said bracket link, one of said links of said first pair is directly connected to said bracket link, and wherein said first and second pairs of links are dimensioned and connected to each other such that when the second pair of links are in said retracted positions thereof, the first pair of links will extend below said second pair of links to define therewith a cavity for receiving a cover adapted to be attached to the footrest and extend over said first and second pair of links, one of said first and second pairs of links including at least one offset portion defining a portion of said cavity.

22. In a chair including a seat, the improvement comprising a footrest assembly including in combination, a footrest, a pair of laterally spaced linkage systems mounting the footrest to the chair for movement between a retracted position generally below the seat and an extended position projected forwardly of the seat, each of said linkage systems defining a cavity when the footrest is in the retracted position, and a foldable cover for the linkage systems extending over the linkage systems and having opposite side portions received in each cavity respectively when the footrest is in the retracted position, and wherein each linkage system includes a first link connected to the footrest, a second link connected to the chair and the first link, said first and second links having along a length thereof means defining a cavity in the retracted position of the footrest such that said cavity extends along said links sufficiently to receive a substantial portion of said cover including a foldable portion of said cover.

23. A footrest assembly for a reclining chair including a footrest, opposed footrest support members connected to the footrest for mounting and supporting the footrest relative to a reclining chair for movement between extended and retracted positions, said support members each including linkages including a mounting link adapted to be mounted relative to the chair and an offset link connected to the footrest while being offset a substantial distance laterally inwardly of the mounting link, a foldable cover having one end attached to the footrest and another end adapted to be attached to an associated chair, said cover being dimensioned to extend over the space between the support members and substantially laterally beyond the offset links, and wherein said mounting link and offset link have along a length thereof means defining a cavity extending a sufficient distance along said links for receiving a substantial portion of said cover including a foldable portion of said cover when the footrest support members are in retracted position.

24. The footrest assembly defined in claim 23 further including a cross brace extending between and fixed to the offset links.

25. A footrest assembly defined in claim 23 wherein said offset links are offset from the mounting links a distance of at least twenty percent (20%) of the distance between the mounting links and a longitudinal axis extending midway between the mounting links.

26. The footrest assembly defined in claim 25 further including a cross brace extending between and fixed to the offset portions.

27. A footrest assembly for a chair comprising in combination, a footrest, a pair of footrest support systems including a linkage and being laterally spaced from each other, said systems having first ends connected to the footrest and opposite ends adapted to be mounted to an associated chair to support the footrest for movement relative to the chair between an extended position wherein the footrest projects forwardly of the chair and a retracted position wherein the footrest is located adjacent the front of the chair, and wherein said linkage in each of said support systems includes first and second links having along a length thereof means defining a cavity when the footrest is in the retracted position, and a cover extends between and has opposite side portions extending over said support systems, said opposite side portions of the cover are received in the cavities defined by the linkage of each support system respectively when the footrest is in the retracted position, and wherein said cover is foldable when the footrest moves between the extended and retracted positions, and wherein said first link is connected to the footrest, said second link is connected to the first link and adapted to be connected to a chair, and said first and second links including said means are arranged such than in the retracted position of the footrest said cavity extends sufficiently along said links to receive a substantial portion of said cover including a foldable portion of the cover.

28. The footrest assembly defined in claim 27 wherein the opposite side portions of the cover are directly connected to the support systems.

29. The footrest assembly defined in claim 27 wherein the opposite side portions of the cover are free of any direct connection to the support systems.

30. The footrest assembly defined in claim 29 wherein the opposite side portions of the cover extend laterally substantially beyond the support systems to conceal the same when the footrest is in the extended position.

* * * * *